United States Patent [19]

Cooke

[11] Patent Number: 4,585,252

[45] Date of Patent: Apr. 29, 1986

[54] SKI SECURITY SYSTEM

[76] Inventor: John E. Cooke, 2295 Willow La., Lakewood, Colo. 80215

[21] Appl. No.: 593,116

[22] Filed: Mar. 22, 1984

[51] Int. Cl.[4] ..... A63C 11/00

[52] U.S. Cl. ..... 280/820; 70/333 A

[58] Field of Search ..... 280/814, 820; 70/50, 70/57, 59, 333 A

[56] References Cited

U.S. PATENT DOCUMENTS 3,335,585 3/1965 Stratton ..... 280/814

4,354,367 10/1982 Wahl ..... 70/333 A

*Primary Examiner*—David M. Mitchell

*Assistant Examiner*—Richard M. Camby

*Attorney, Agent, or Firm*—Donald W. Margolis

[57] ABSTRACT

A security system is provided for locking ski equipment, including skis and ski poles, to each other and to a fixed anchor, the security system being part of the ski pole equipment itself. This is accomplished using a ski pole with a handle which carries a locking mechanism, and a hollow shaft which carries a flexible security line. The locking mechanism includes a double locking system which prevents release of the security line until both a first lock (preferably of the combination type) and an integrated second mechanical lock have both been positively activated by the user. The locks are designed and located for easy access and are positively controlled to release or limit the movement of the security line, preferably without a separate key. The flexible security line which is held in the shaft of the pole is capable of being removed from the shaft to form a security loop by which the pole and other articles strung on or encircled within the security loop may be connected to a fixed anchor in order that falling, movement and theft of the pole and other strung on or encircled articles can be avoided.

11 Claims, 7 Drawing Figures

SKI SECURITY SYSTEM

BACKGROUND OF THE INVENTION

1. Field of the Invention

This invention relates to a new and useful ski pole and locking device combination which is designed to deter theft of the pole and other articles connected thereto. More particularly, it relates to the combination of a ski pole which incorporates a security line and a double locking mechanism suitable for securing and locking ski equipment together and to a convenient fixed anchor.

2. Description of the Prior Art

In recent years, there has been a substantial increase in interest and activity in the sport of skiing. During the same period, ski equipment, such as skis, bindings, and poles have become more sophisticated and more expensive. With this increase in interest and in the cost of ski equipment, there has also been a concommittant increase in theft of the ski equipment at ski areas or wherever the equipment may be left unattended.

In the normal course of a day's skiing, a skier is usually required to leave his ski equipment unattended while he enters a ski area building to eat, to warm himself, to purchase other equipment or to otherwise avail himself of the comforts provided within such buildings. At such times, skis and poles are generally placed in a vertical position on a rack, or, under crowded circumstances, against a building, against a tree, or forced tail first into the snow. When equipment is thus left unattended, there is usually a concern experienced by the skier that when he returns, his equipment will have been knocked over and damaged, or moved, thus making it difficult to find, or stolen. Sometimes a skier will separate his skis and poles or form a mixed pair with a companion on the assumption that a thief will not steal a single ski or an unmatched pair. This form of safeguard still subjects the skis to being knocked down or moved, and may also be defeated by a vigilant or lucky thief.

At most ski areas, coin operated lockers or racks with lock assemblies can be rented for storage of skis during indoor breaks. This, however, can be inconvenient, in terms of having the right change, and expensive if the skier takes frequent breaks or is responsible for the equipment of a number of family members or companions.

Various portable locking devices are available which may be carried by a skier. However, due to the already great weight of the ski equipment and/or the bulk of the skier's clothing, such as gloves and parkas, most skiers would prefer not to have to carry any separate or additional equipment. As may be appreciated, these separate locking devices have the added disadvantage of consuming space in the skier's pockets or pack and may also provide a potential for injury to the skier if he falls on the device.

Therefore, due to the inadequacies of existing equipment, hundreds of thousands of skiers on millions of ski trips a year assume the risk that their equipment may be damaged, misplaced or stolen.

The problems of ski equipment security and of the then state-of-the-art is further discussed in Quigg U.S. Pat. No. 3,354,675. l The various reference patents cited in Quigg and the following additional U.S. Patents disclose several types of security devices or locks which have been corporated into ski poles: Schwedt, et al U.S. Pat. No. 3,297,333; Stratton U.S. Pat. No. 3,335,585; Brimhall U.S. Pat. No. 3,899,904; and Aylesworth U.S. Pat. No. 4,267,715. These references, the references cited in them, and the following additional patents relating to lock mechanisms of the type which includes some sort of security line, serve the purpose of putting the present invention into proper perspective relative to the prior art: Richardson U.S. Pat. No. 563,414; Goodridge U.S. Pat. No. 1,724,835; Gordon U.S. Pat. No. 2,186,456; Bagnall, Jr. U.S. Pat. No. 2,457,195; Pennington U.S. Pat. No. 2,488,984; Stue U.S. Pat. No. 2,508,302; and Swiss Pat. No. 243,551.

Of these references, Stratton, Quigg, Brimhall and Aylesworth all specifically disclose ski equipment security systems which include a security line (usually a flexible steel cable) which is carried in the hollow shaft portion of a ski pole. These references all provide for some means to allow or cause the security line to be removed from the pole and also provide a locking mechanism in the pole grip or on the pole shaft to secure the free end of the security line after it has been looped around and through skis, the other pole, and a fixed anchoring structure such as a rack, a tree, a rail or the like. More specifically, Stratton and Brimhall (at its FIG. 3) disclose systems in which the ski pole grip carries a cylindrical combination lock, and in which further the free end of the security line is inserted into an existing hollow portion of the cylindrical lock. In these latter two references, there is little more than an aggregation of a lock-security line and a pole for purposes of convenience, with little cooperation between the pole and the lock-security line system. Additionally, when the systems of Stratton and Brimhall (at its FIG. 3) are unlocked by operating their combination locks, they are subject to immediate release of the security line. Such uncontrolled release can result in a skier operating the combination and having the security line system release from the lock under the weight of the equipment with the potential for the equipment to fall and injure the skier or damage itself.

The present invention provides a simple, effective security system for locking ski equipment, including skis and ski poles, to each other and to a fixed anchor. It provides the foregoing security system as part of the ski pole equipment itself. In preferred embodiments, a lock, a flexible security line and ski pole combination is provided in which the lock includes a double locking system which prevents release of the security line until both a first and a second lock have been positively activated by the user.

The system is designed so that the ski pole shaft carries in combination the flexible security line, with a first lock of the combination type integrated with a second mechanical lock, both locks being incorporated in the handle or grip of the ski pole. The locks are designed and located for easy access and are positively controlled to release or limit the movement of the security line, preferably without a separate key. As noted above, the flexible security line is normally held in the shaft of the pole and is capable of being removed from the shaft to form a loop by which the pole and other articles strung on or encircled within the loop may be connected to a fixed anchor in order that falling, movement and theft of the pole and other strung on or encircled articles can be avoided. Additionally, the free end of the flexible security line which is removed from the pole carries a portion of a locking mechanism positioned and designed for positive, controlled, releasable locking engagement with another portion of the locking mechanism which is located within the pole grip.

The combination of a first lock, a second lock, a security line and a ski pole, in accordance with the present invention, is characterized by economy of manufacture, simplicity of operation, and controlled release.

Accordingly, it is an object of this invention to provide a simple yet effective device for securing and locking ski equipment, including skis and ski poles, to each other and to a fixed anchor.

Another object of this invention is to provide the foregoing as part of the ski pole equipment itself.

A further object of this invention is to provide a lock, a security line and ski pole combination in which the lock includes a double locking system which prevents release until both a first and a second lock have been positively activated by the user.

In one preferred aspect thereof, the combination of a first lock, a second lock, a security line and a ski pole in accordance with the present invention are characterized by economy of manufacture, simplicity of operation, and controlled release.

Another object of the present invention is to provide in combination a ski pole in which a security line is carried, and a first lock of the combination type is integrated with a second mechanical lock, and that both locks are incorporated in the pole handle or grip of the ski pole and available for easy access and positive controlled release of the security line without a separate key.

A still further object of the invention is to provide a structure as above characterized, that includes a flexible security line which is normally held in the shaft of the pole and capable of forming a loop by which the pole and other articles strung on or encircled within the loop may be connected to a fixed anchor in order that falling, movement and theft of the pole and other strung on or encircled articles is avoided.

Yet a further object of the invention is to provide a structure as above, further characterized by the provision of a flexible security line having a free end, capable of being removed from the pole, and said free end carries a portion of a locking mechanism positioned and designed for positive, controlled, releasable locking engagement with a second portion of said locking mechanism provided within the pole grip.

These and other objects of the present invention will become apparent to those skilled in the art from the following detailed description, showing the contemplated novel construction, combination, and arrangement of parts as herein described, and more particularly defined by the appended claims, it being understood that such changes in the precise embodiments of the herein disclosed invention are meant to be included as come within the scope of the claims except insofar as precluded by the prior art.

BRIEF DESCRIPTION OF DRAWINGS

The accompanying drawings illustrate complete preferred embodiments of the present invention according to the best mode presently devised for the practical application of the principles thereof, and in which.

DESCRIPTION OF THE PREFERRED EMBODIMENT

Figure 2:
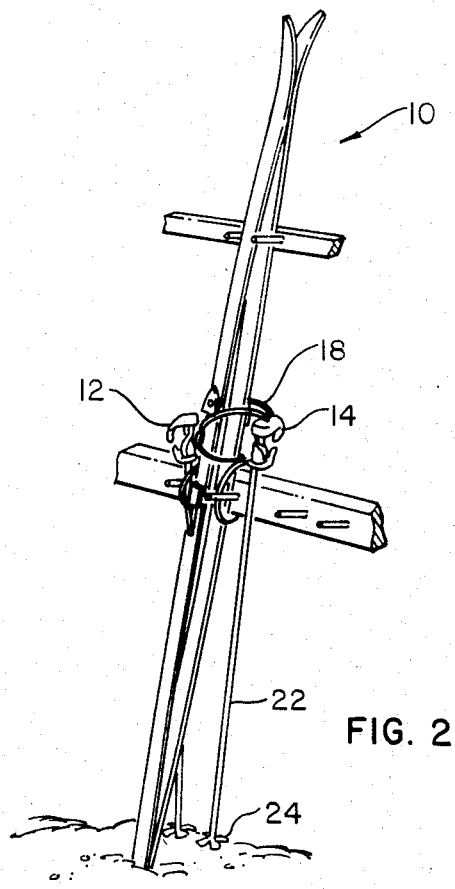
FIG. 2 is a somewhat schematic view illustrating the manner in which the locking system of the present invention is used to secure skis and ski poles to each other and to an anchoring location.

Referring now in detail to the illustrative embodiments depicted in the accompanying drawings, there is shown in FIG. 2 a pair of skis 10 and a pair of ski poles 12 and 14 secured to a fixed ski rack by means of a flexible security line 18 in operative locking relation according to the present invention. Pole 14 provides in combination the security line-locking mechanisms and ski pole of the present invention.

In the embodiment shown, ski pole 14 is provided with a cutlass type handle or grip 20 at its upper end, a hollow body shaft or tube 22, and a conventional lower end which includes basket 24 for controlling the penetration of shaft 22 into the snow during skiing. Grip 20 has been designed in accordance with this embodiment of the present invention to provide locking mechanism body cavity 26.

Figures 3, 7:
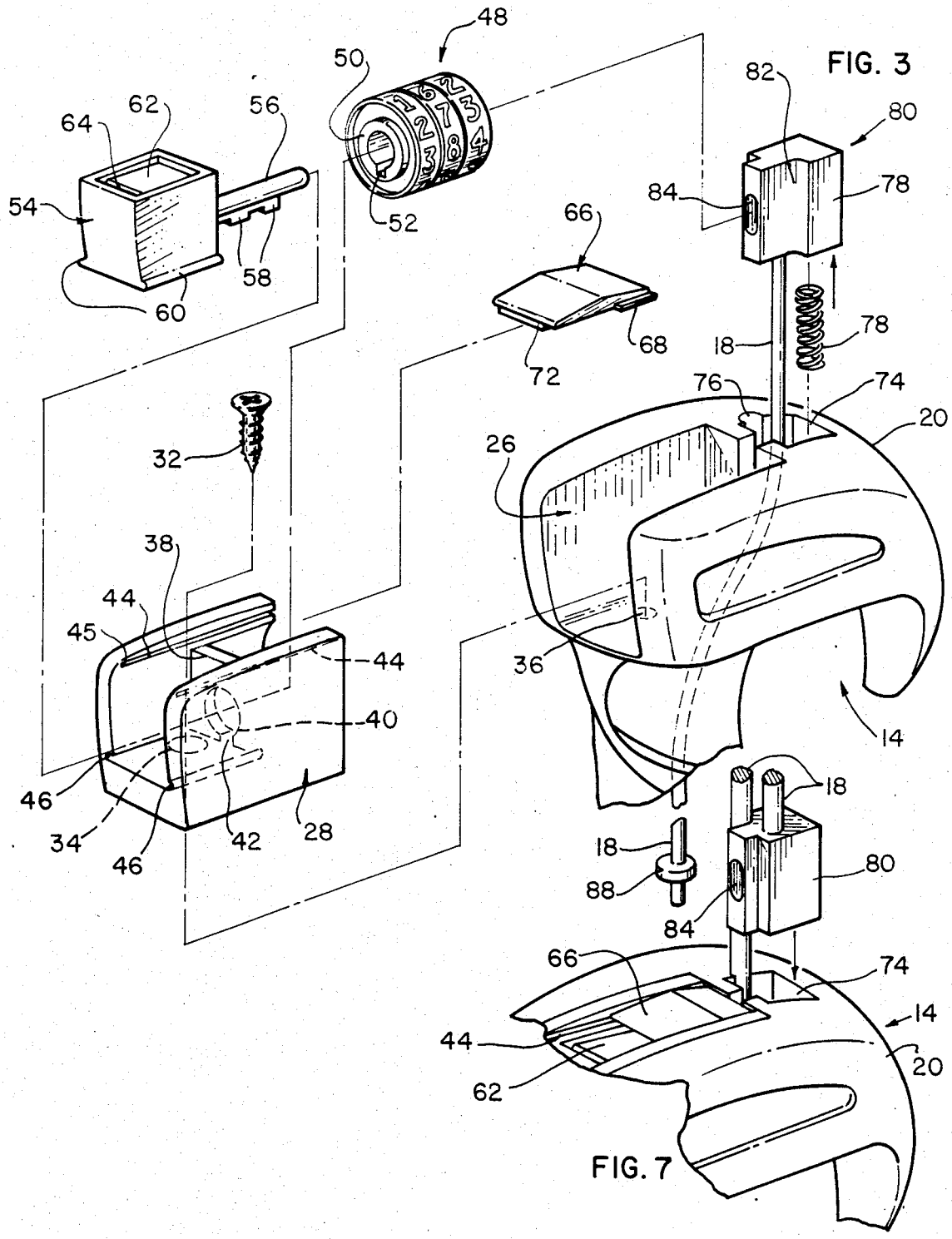
FIG. 3 is a fragmentary, exploded pictorial perspective view of the embodiment of the present invention shown in FIG. 1.
FIG. 7 is a fragmentary perspective view of the locking system of the present invention with the security line formed in a loop and about to be secured in a ski equipment securing position, such as that illustrated in FIG. 2.
Figure 4:
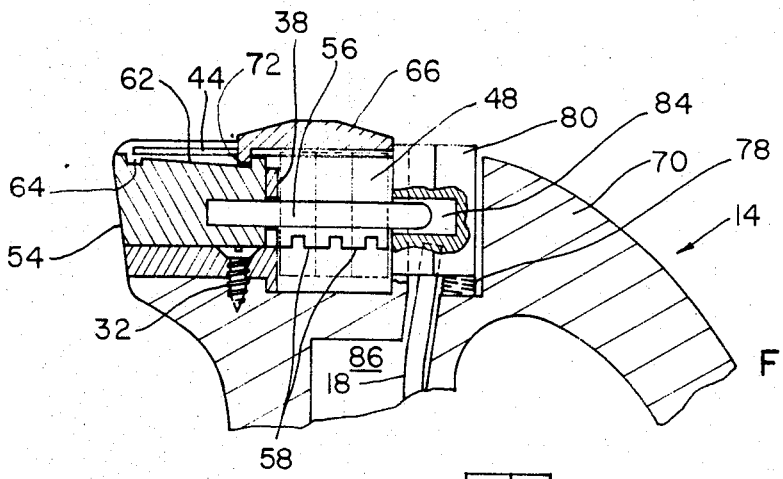
FIG. 4 is a fragmentary cross-sectional view taken along line 4—4 of FIG. 1 showing the double locking systems of the present invention when they are in repose and the ski pole is in a mode ready for skiing.
Figure 5:
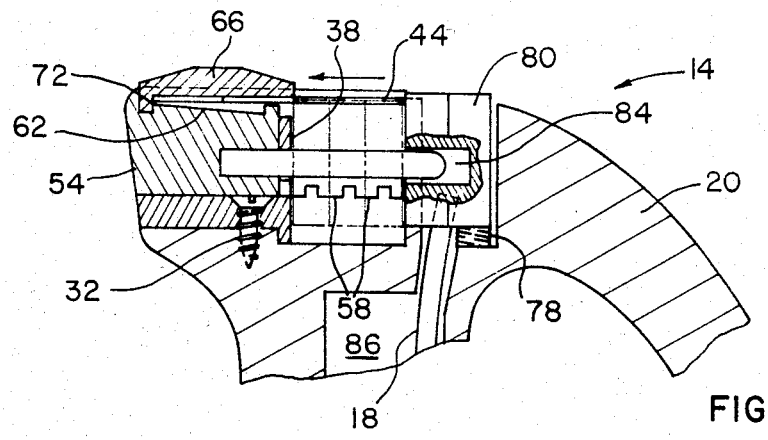
FIG. 5 is a cross-sectional view similar to FIG. 4 showing the first locking mechanism exposed for unlocking.

The details of the locking mechanisms of the present invention can be most readily understood by referring to FIGS. 3 through 6. In the preferred embodiment shown, lock body supporting basket 28 is designed to be secured within cavity 26, for example by means of lock body screw 32, which passes through hole 34 of basket 28 and into screw hole 36 at the bottom of cavity 26. As will be appreciated hereinafter, connecting lock body screw 32 is not externally visible or accessible, when the locking mechanism of the present invention is in a locked position as shown in FIGS. 4 and 5 and therefore cannot be easily tampered with.

Lock body supporting basket 28 carries vertical key guiding support wall 38 having key opening 40 therethrough and its connected tooth slot 42. The inner surfaces of the upper portions of the opposed side walls of basket 28 each include a sliding door groove 44. Grooves 44 face inwardly and are opposed to one another. Door grooves 44 extend along substantially the entire width of each side wall, each terminating at stop 45. Each side wall of basket 28 also carries a pair of key activator slide grooves 46 at the bottom of the sidewalls of basket 28, said slide grooves 46 facing inwardly and in opposition to one another. Lower slide grooves 46 begin at the left side of support wall 38 and extend laterally to the open left end of the supporting basket side walls.

In this preferred embodiment, a standard cylindrical type combination lock 48 is suitable for use. In this instance, lock 48 is illustrated as having three lock rings supported on a cylindrical centrally open barrel 50. Lock 48 is of standard construction and when each of the three lock rings is arranged in the "unlocked" combination, it comes into an "open" position in which tooth-slot 52 of each of the three lock rings (only outermost shown) is in alignment, and in which tooth-slot 52 is also positioned to coincide and be in alignment with tooth-slot 42 carried by support wall 38.

Key activator 54 carrying key 56 bearing teeth 58 and having at its lower edge a pair of outwardly extending slides 60 is provided. The upper surface of key activator 54 defines a recess at the bottom of which is cam surface 62 which terminates at its left side in groove 64. As illustrated, key activator slides 60 are dimensioned to slidingly fit within lower slide grooves 46, while key 56 and teeth 58 are carried in a position to enter and slide within key opening 40 and tooth-slot 42, respectively, of wall 38. In a similar manner, as detailed below, key 56 and teeth 58 are also located to enter and reside within the open center of barrel 50 and tooth-slot 52, respectively, of lock 48.

Locking and key activating door 66 including door slides 68 on each side and lower cam following tab 72 is provided. Door 66 is designed and dimensioned so that its slides 68 may be placed into and slid along upper grooves 44 of supporting basket 28. When key activator 54 is positioned totally within basket 28 with its slides 60 in lower grooves 46, and when door 66 is positioned to the right within upper grooves 44, as shown in FIG. 4, then lateral leftwards movement of door 66 will cause its lower cam following tab 72 to contact and travel along cam 62 until it reaches, snaps into and is stopped at groove 64 when in an extreme left position, as shown in FIG. 5.

Grip 20 defines at its upper surface, adjacent to cavity 26, substantially rectangular keeper retainer cavity 74 and adjacent semi-circular channel 76. Spring 78 is secured at the bottom of cavity 74. Keeper 80, also having a substantially rectangular configuration but for curved channel 82 is firmly attached to the top of flexible security line 18. One lateral surface of keeper 80 carries a boss which includes an opening to key receiving cavity 84. Flexible security line 18 is firmly secured to keeper 80 and extends from keeper 78 through channel 86 of grip 20 into hollow pole shaft 22. Security line 18 terminates at security stop 88 which is firmly secured to its lower end. Security stop 88 is dimensioned so that it is small enough to move easily through pole shaft 22 and channel 86, but so that it is too large to enter cavity 74. Thus, stop 88 prevents the removal of flexible security line 18 from grip 20 through cavity 74.

When the elements set forth in FIG. 3 are combined, as detailed in FIG. 4, lock 48 will reside at the right side of support wall 38 of basket 28. Basket 28 will be secured within recess 26 by means of screw 32 passing through holes 34 and 36. Slides 60 of key activator 54 will be positioned within grooves 46 of basket 28 and key 56 and teeth 58 will be located to pass through key opening 40 and tooth-slot 42, respectively, and into the central opening of barrel 50 of lock 48 with teeth 58 initially in alignment with tooth-slot 52 of all three lock rings. Lock and key activating door 66 will be slidingly located within upper grooves 44 of basket 28 by means of slides 68. When keeper 80 is inserted into keeper cavity 74, depressing spring 78, and key activator 54 is positioned fully to the right, as shown in FIG. 4, the distal end of key 56 will engage key receiving cavity 84 of keeper 80 so that keeper 80 is positively locked into cavity 74.

In operation, keeper 80 can be further secured against movement out of cavity 74 by rotating the rings of lock 48 into a locked relationship so that tooth-slot 52 is blocked at one or more ring positions. When the lock rings are so rotated, lock 48 will secure teeth 58, attached key 56, and attached key activator 54 against leftward lateral movement away from keeper 80. When so secured, the distal end of key 56 will be locked within keeper cavity 74, thus securing and double locking keeper 80 against movement out of keeper cavity 74. When cylinder lock 48 has been so engaged, it will also secure key 56 and attached key activator 54 so that they cannot then be moved laterally to the left through basket 28.

Figure 1:
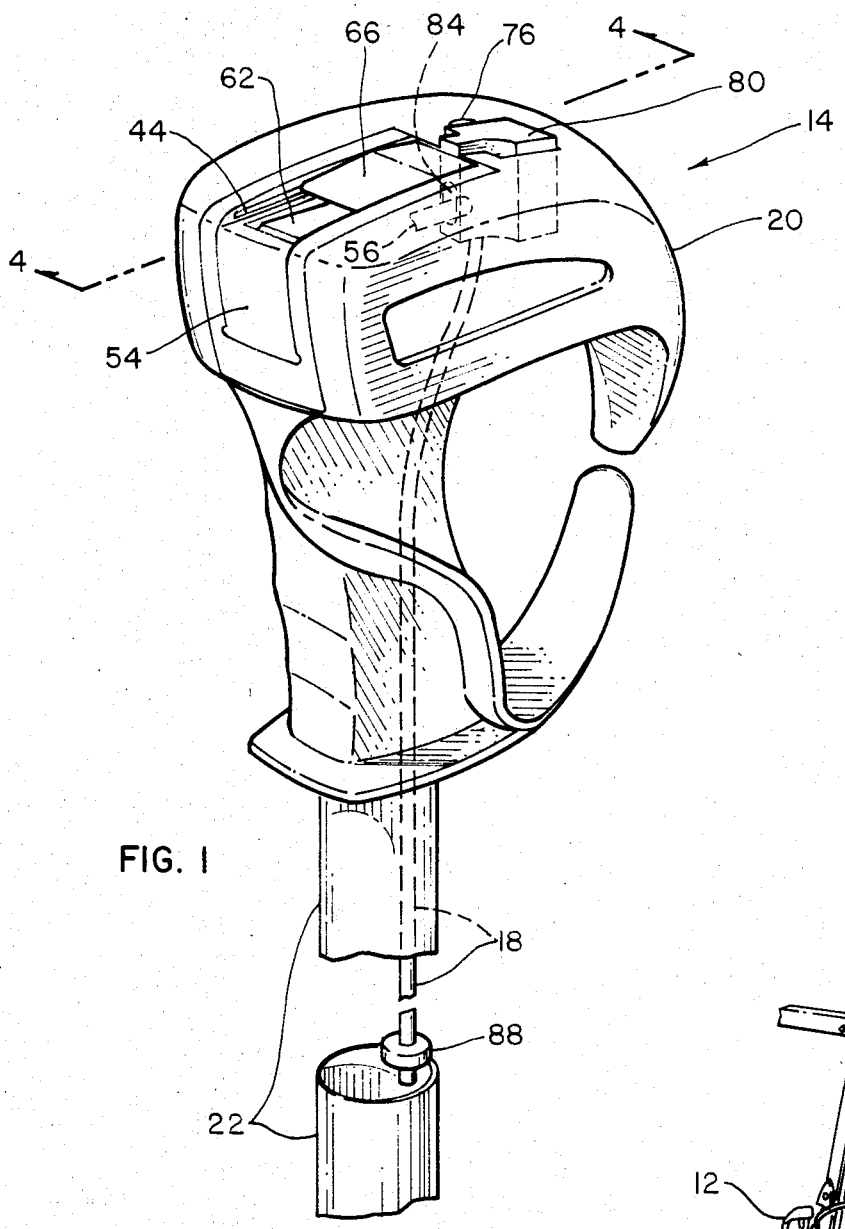
FIG. 1 is a fragmentary perspective view of a ski pole incorporating the double locking system of the present invention.

Keeper 80 will be released from the locked relationship shown in FIGS. 1 and 4, and used to secure ski equipment as shown in FIG. 2, by the following sequence of double unlocking and double relocking steps. First, starting with the arrangement shown in FIG. 4, lock and key activator door 66 will be slid laterally to the left until tab 72 snaps into and becomes engaged within groove 64 at the upper left surface of key activator cam 62, at which point the lateral motion of activator door 66 and tab 72 connected key activator 54 will be stopped, as shown in FIG. 5, by stop 45 (see FIG. 3). When door 68 is in this "open" position, it will allow access to the combination lock rings of lock 48 so that the combination lock rings of lock 48 may be sequenced to "open". When the lock combination is so sequenced, tooth-slot 52 will be aligned in each ring cylinder of the lock as well as with teeth 58 of key 56 and toothslot 42 of wall 38. However, after this unlocking sequence is completed, nothing will occur to release keeper 80 from handle 20 until the second lock is released.

The second lock is released after lock 48 is sequenced open by now again exerting lateral leftwards force upon activator door 66. Due to the placement of tab 72 within groove 64 and in view of the now unblocked open alignment of tooth-slot 42, tooth-slots 52 and key teeth 58, additional lateral leftwards movement of activating door 66 is now possible. This additional lateral leftwards movement of door 66 will now cause tab 72 connected key activator 54 and attached key 56 to also be moved laterally to the left. When the distal end of key 56 is moved sufficiently to the left so that it is removed from cavity 84 of keeper 80, then spring 78 will urge keeper 80 out of cavity 74, as shown in FIG. 6.

Figure 6:
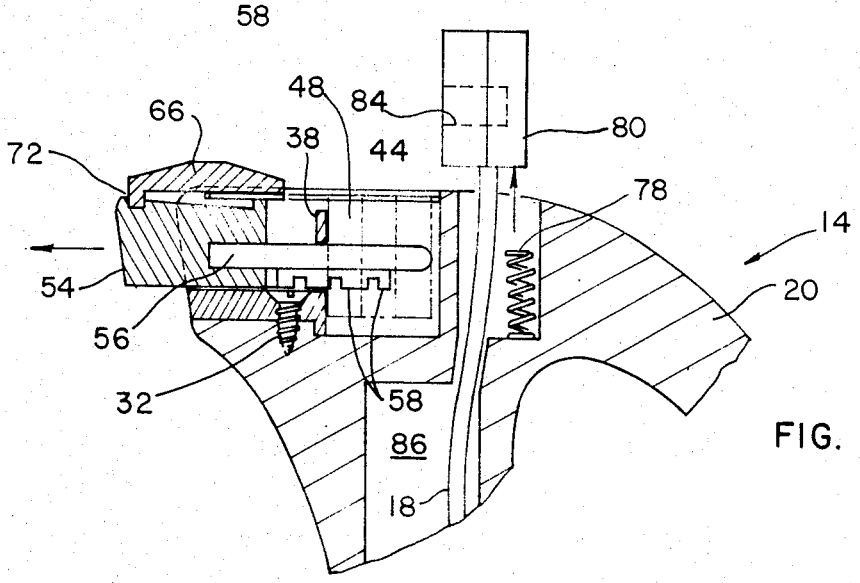
FIG. 6 is a cross-sectional view similar to FIGS. 4 and 5 showing the second locking mechanism activated for release of the security line from the ski pole grip.

The ski security system of the present invention is now in the mode for locking and securing skis or other items when keeper 80 has been released from cavity 74, as shown in FIG. 6. At this time, skis 10 and ski pole 12 will typically be placed in a substantially vertical position against a fixed anchor support, such as a rack, as shown in FIG. 2. Now, with keeper 80 released from pole 14, keeper 80 and a length of attached security line 18 can be withdrawn from pole 14, wrapped about or through skis 10, the other pole 12 and the fixed support rack. Referring to FIG. 7, keeper 80 will then be returned to the vicinity of cavity 74, but inverted so that what had been the top of keeper 80 when secured within cavity 74 in FIGS. 1 and 4 becomes the bottom or first portion of keeper 80 to approach and enter cavity 74. As inverted keeper 80 is inserted into cavity 74, the portion of security line 18 which is then located in cavity 74 will be positioned within semi-circular channel 76 and also bracketted by curved channel 82 of keeper 80. When keeper 80 is fully inserted within cavity 74, channels 76 and 82 will oppose one another and define a substantially circular groove to accommodate the portion of security line 18 extending through cavity 74. Also, when keeper 80 is fully inserted into cavity 74, spring 78 will be compressed.

Now, with keeper 80 fully inserted within cavity 74 and spring 78 compressed, the double locking security sequence will be initiated. The double locking sequence is substantially the reverse of the unlocking sequence already described. First, activator door 66 is moved laterally to the right. Due to the placement of tab 74 within groove 64 of key activator 54, movement of door 66 to the right will cause key activator 54 and attached key 56 to also be moved laterally to the right. When the distal end of key 56 is moved to the right a sufficient distance, it will enter and engage cavity 84 of keeper 80, thus mechanically securing keeper 80 within cavity 74 of grip 20, as shown in FIG. 2. This first locking sequence and arrangement is substantially analogous to the locking arrangement shown in FIG. 5, with the exception that the keeper is inverted and a loop of security line 18 is external to pole 14. Then, with door 66 still open, the lock cylinders are spun out of the "open" combination to provide the second locking sequence which secures key 56 from movement out of cavity 84. Now, additional lateral rightwards movement of door 66 will cause cylindrical combination lock 48 to be covered and protected, in much the same manner as is illustrated in FIG. 4, with the exception that the keeper is inverted and a loop of security line 18 is external to pole 14. Skis 10 and poles 12 and 14 will now be securely locked to the rack, for example as shown in FIG. 2, and will remain so locked until the user opens door 66, redials the correct lock combination to open the first lock, and then moves key activator 54 to the left to open the second lock and release keeper 80 from cavity 74.

The double locking mechanism of the present invention will allow the user to unlock the first (combination) lock without releasing the secured skis and poles from their anchor. Only after the second lock mechanism has been activated, will the security system be released. This will allow the user to secure or balance the equipment before the security line is released from keeper cavity 74, thus assuring that the equipment will not accidentally fall and be damaged or injure the user.

This double locking mechanism will also make "cracking" of the combination lock sequence more difficult. A would-be thief will be unsuccessful in breaking the code merely by sequencing numbers and watching for the lock to fall open when the right sequence is found. Rather, after each combination sequence, the second lock will have to be manipulated to check the condition of the combination lock. This tedious second step, or the lack of knowledge of this second operation, will make theft through tampering more difficult.

In use, the weight of a pole embodying the security system of the present invention will be on the order of only about three to five ounces greater than that of the other pole with which it is paired. While the other pole may be weighted to offset this weight differential, the imbalance is so minor that it will go practically unnoticed in use.

While in use as a ski pole, rather than as a security system, both locks of pole 14 need not be engaged. For example, once key 56 has been inserted into cavity 84 of keeper 80, the combination lock does not have to be engaged. Nevertheless, keeper 80 will be mechanically secured while the user is skiing, and can then be quickly and readily released without operating the combination when it is needed for use as a ski security system.

Alternative embodiments which practice the teaching of the present invention, although not shown herein, may be readily provided by one skilled in the art. For example, the keeper mechanism may be located to the left of the grip, and the locking mechanisms to the right. In a similar modification, the locking mechanism may be located within the lower body portion of grip 20 with the keeper being inserted either as taught, or into the front of the grip. Reversal of parts in the mechanical locking mechanism is readily achieved, as it would be relatively simple to have the key operate as a female to interact with a keeper which provides a male connecting member.

While a cutlass style grip 20 has been shown, a linear handle grip, with or without a safety strap, may also be used in the practice of the present invention. The locking mechanisms have been shown as supported and positioned within the handle by separate basket structure 28. It is apparent that the same positioning and support functions can be provided as an integral part of the handle itself. Cam surface 62 carried by key activator 54 is shown as being a ramp rising to the left. However, in practice, cam surface 62 will be operative to perform its desired function whether it rises to the left, rises to the right, rises on both the left and the right, or is flat.

The choice of materials for use in the practice of the present invention will vary widely, with many materials being suitable for its operation and implementation. In preferred embodiments, a standard, hollow, lightweight metal ski pole shaft and its attached basket will be modified for use in the practice of the present invention by the addition of a grip designed to contain the double locking mechanism and security line system taught herein. For ease of manufacture, the grip will most often be of molded lightweight plastic, while the key locking mechanism and keeper may be of molded or machined plastic or of metal. The structure is not material limited. As has been previously indicated, combination lock 48 disclosed herein is of a standard variety now readily available. Other combination locks or even key activated locks may be readily substituted for lock 48. Also as previously indicated, the flexible security line 18 will normally be a braided or twined steel cable, although any material which is resistant to breaking and cutting may be used. The length of the security line may vary considerably, and is not critical. The maximum length of the line will normally be limited by the length of the ski pole, say in the range of about 36 to about 50 inches, although a bobbin arrangement within the ski pole shaft may allow for wound line of almost any length. The minimum length of the security line will be dictated by its function, and will seldom be less than about 20 inches if it is intended to secure a pair of skis around an anchoring element.

While the modifications to the ski pole grip of the present invention are rather unobtrusive, they will be sufficiently noticeable to the user so that they will provide a means by which he can readily identify a right-hand pole from a lefthand pole, if the poles are so designed, thus providing an additional benefit to the user.

It has thus been shown that the present invention provides a simple, yet effective device for securing and locking ski equipment, including skis and ski poles, to each other and to a fixed anchor. The preferred embodiment has shown how the security system is provided as a lock mechanism, a security line and ski pole combination in which the lock mechanism includes a double locking system which prevents release until both a first and a second lock have been positively activated by the user. Such a combination of a first lock, a second lock, a security line and a ski pole are characterized by economy of manufacture, simplicity of operation, and controlled release. It is further seen that the preferred embodiment of the present invention provides, in combination a ski pole in which a security line is carried, and in which a first lock of the combination type is integrated with a second mechanical lock. In such a combination, both locks are incorporated in the pole handle or grip of the ski pole and available for easy access and positive controlled release of the security line without a separate key. Furthermore, the present invention provides a structure as hereinabove characterized, that includes a flexible security line which is normally held in the shaft of the pole and which is capable of forming a loop by which the pole and other articles strung on or encircled within the loop may be connected to a fixed anchor in order that falling, movement and theft of the pole and other strung on or encircled articles is avoided. In such an embodiment, the flexible security line has a free end capable of being removed from the pole, and said free end carries a portion of a locking mechanism positioned and designed for positive, controlled, releasable locking engagement with a second portion of said locking mechanism provided within the pole grip.

While the locking mechanism of the present invention has been shown as integrated with and part of a ski pole, and for use as a ski security system, it is to be understood that the double locking security line mechanism of the present invention may have other utility and may be incorporated into other structures, particularly into some other shaft or tube type of a structure, such as a bicycle frame.

While the invention has been particularly shown and described with reference to preferred embodiments thereof, it will be further understood by those skilled in the art that the foregoing and other modifications or equivalent changes in form and details may be made therein without departing from the spirit and scope of the invention as claimed, except as precluded by the prior art.

What is claimed is:

1. A combined ski pole and double locking security system device wherein the ski pole includes a longitudinal shaft having a hollow interior and a handle connected to the shaft, wherein the improvement comprises in combination:

(a) a passageway through the handle said passageway extending from an exterior surface opening of the handle to connect with the hollow interior of the shaft;

(b) a flexible security line having a first end and a second end, said security line being movably disposed within said handle passage and the hollow interior of the pole shaft with said first end of said security line being located in the vicinity of the exterior surface opening of said handle passageway;

(c) first lock means having at least two portions, said first portion of said first lock means being located substantially within the handle and including a protrusion, while said second portion of said first lock means is connected to said security line in the vicinity of its said first end and carries means for releasably connecting with said protrusion included in said first portion, said first portion of said first lock means also being located to releasably connect with said second portion of said first lock means, said first lock means further including means for actuating said first lock actuating means which lock actuating means are located to be activated from the exterior of the handle; and (d) second lock means, said second lock means also located substantially within the handle, said second lock means being in operative association with said first lock means to control the connection and release of said first and second portions of said first lock means; whereby, when said second lock means allows the release of said first and second portions of said first lock means and when further said first portion is released from said second portion of said first lock means, said second portion of said first lock means and said connected security line can be moved from and through said handle passageway to the exterior of the handle, and thence, with a portion of said security line still at the exterior of the handle, said second portion of said first lock means can be returned to said handle passageway for releasable connection with said first portion of said first lock means.

2. The security system of claim 1 wherein said protrusion includes a key, said key being integral with said first lock means and substantially permanently carried as a portion of said security system.

3. The security system of claim 2 wherein said means for releasably connecting with said protrusion is a keeper defining an opening for releasably receiving said key, said keeper being connected at said first end of said security line and located in the vicinity of the exterior surface opening of said handle passage.

4. The security system of claim 1 wherein said means for releasably connecting with said protrusion is a keeper defining an opening for releasably receiving said protrusion.

5. The security system of claim 1 wherein said second lock means is of a combination type.

6. The security system of claim 5 wherein said combination lock has a hollow blockable center, wherein said protrusion is a key, and wherein said key extends through said hollow center of said combination lock, whereby it is blocked or released by said blockable center.

7. The security system of claim 6 wherein said combination lock can be operated from the exterior of the handle.

8. The security system of claim 7 wherein door means are provided to open and close access to said combination lock.

9. The security system of claim 8 wherein said door means is connected to and can serve as a means for moving said key through said hollow center of said combination lock and into and out of said means for releasably connecting with said key.

10. The security system of claim 9 wherein said means for releasably connecting with said key is a keeper defining an opening for releasably connecting with said key.

11. The security system of claim 10 wherein said security line has a stop connected in the vicinity of its said second end and spaced from said keeper, said stop being dimensioned to travel with said security line through the pole shaft, but to be blocked within said handle passage, whereby said second end of said security line cannot be readily removed from said handle.

* * * * *